US009466912B2

(12) United States Patent
Matsumoto

(10) Patent No.: US 9,466,912 B2
(45) Date of Patent: Oct. 11, 2016

(54) CONNECTOR

(71) Applicant: JAPAN AVIATION ELECTRONICS INDUSTRY, LIMITED, Shibuya-ku, Tokyo (JP)

(72) Inventor: Masakazu Matsumoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/515,354

(22) Filed: Oct. 15, 2014

(65) Prior Publication Data

US 2015/0147898 A1 May 28, 2015

(30) Foreign Application Priority Data

Nov. 27, 2013 (JP) ..... 2013-245042
Jun. 27, 2014 (JP) ..... 2014-133000

(51) Int. Cl.

| | |
|---|---|
| ***H01R 24/28*** | (2011.01) |
| ***H01R 13/44*** | (2006.01) |
| *H01R 4/02* | (2006.01) |
| *H01R 107/00* | (2006.01) |

(52) U.S. Cl.

CPC ..... *H01R 13/44* (2013.01); *H01R 4/028* (2013.01); *H01R 2107/00* (2013.01)

(58) Field of Classification Search

CPC ... H01R 13/44; H01R 4/028; H01R 2107/00
USPC ..... 439/135, 693, 692, 884, 752
See application file for complete search history.

(56) References Cited

U.S. PATENT DOCUMENTS 3,969,012 A * 7/1976 Bauer ..... H01R 13/04 439/884
4,647,122 A 3/1987 Kelly
(Continued)

FOREIGN PATENT DOCUMENTS

CN 101354930 A 1/2009
DE 19953663 A1 5/2000
(Continued)

OTHER PUBLICATIONS

Extended European Search Report dated Mar. 5, 2015, issued in counterpart European Application No. 14190174.4.
(Continued)

*Primary Examiner* — Abdullah Riyami
*Assistant Examiner* — Nelson R Burgos-Guntin
(74) *Attorney, Agent, or Firm* — Holtz, Holtz & Volek PC

(57) ABSTRACT

A connector is mateable with a mating connector along a predetermined direction. The connector comprises a holding member, a plurality of contacts and a plurality of contact prevention members. The holding member includes a holding portion. The plurality of contacts include held portions and main portions, respectively. The held portions are held by the holding portion. The main portions extend from the held portions, respectively, in the predetermined direction. The main portions project over the holding portion in the predetermined direction. Each of the main portions has a tubular shape. Each of the contact prevention members is made of insulator. The contact prevention members occupy insides of the main portions, respectively. The contact prevention members project over the main portions, respectively, in the predetermined direction.

11 Claims, 15 Drawing Sheets

(56) References Cited

U.S. PATENT DOCUMENTS

| | | | | |
|---|---|---|---|---|
| 4,906,212 | A * | 3/1990 | Mixon, Jr. | H01R 13/111 439/857 |
| 5,108,317 | A * | 4/1992 | Beinhaur | H01R 43/24 264/274 |
| 6,113,436 | A * | 9/2000 | Kuwahara | H01R 13/44 439/693 |
| 6,146,211 | A | 11/2000 | Okamoto et al. | |
| 6,482,036 | B1 * | 11/2002 | Broussard | H01R 13/523 439/606 |
| 6,638,108 | B2 * | 10/2003 | Tachi | H01R 13/4223 439/540.1 |
| 7,118,425 | B2 * | 10/2006 | Chen | H01R 13/405 439/736 |
| 7,192,313 | B2 * | 3/2007 | Sai | H01R 13/53 439/660 |
| 7,470,154 | B2 | 12/2008 | Sato | |
| 7,674,137 | B2 | 3/2010 | Sato | |
| 8,398,442 | B2 | 3/2013 | Yagi et al. | |
| 2008/0299832 | A1 * | 12/2008 | Umemura | H01R 13/426 439/638 |
| 2012/0003883 | A1 * | 1/2012 | Pavlovic | H01R 13/187 439/840 |
| 2014/0329396 | A1 | 11/2014 | Okayasu et al. | |
| 2015/0147898 | A1 * | 5/2015 | Matsumoto | H01R 13/44 439/135 |

FOREIGN PATENT DOCUMENTS

| | | | |
|---|---|---|---|
| EP | 2418743 | A1 | 2/2012 |
| EP | 2660936 | A1 | 11/2013 |
| JP | 62044968 | A | 2/1987 |
| JP | 09148004 | A | 6/1997 |
| JP | 2000058205 | A | 2/2000 |
| JP | 2000150040 | A | 5/2000 |
| JP | 3575295 | B2 | 10/2004 |
| JP | 2008108675 | A | 5/2008 |
| JP | 2014063687 | A | 4/2014 |
| WO | 2011030712 | A1 | 3/2011 |

OTHER PUBLICATIONS

Japanese Office Action dated Mar. 19, 2015, issued in counterpart Japanese Application No. 2014-133000.

Japanese Office Action dated Jan. 15, 2015, issued in counterpart Japanese Application No. 2014-133000.

Chinese Office Action (and English translation thereof) dated Jun. 29, 2016, issued in counterpart Chinese Application No. 201410696840.6.

* cited by examiner

CONNECTOR

CROSS REFERENCE TO RELATED APPLICATIONS

An applicant claims priority under 35 U.S.C. §119 of Japanese Patent Application No. JP2013-245042 filed Nov. 27, 2013 and Japanese Patent Application No. JP2014-133000 filed Jun. 27, 2014.

BACKGROUND OF THE INVENTION

This invention relates to a connector with a structure which prevents a finger of a user from being in contact with a tip of a contact.

As shown in FIG. 29(*a*), a connector 100 of JP 3,575,295B comprises a contact 101, a holding member 102 holding the contact 101, and a contact prevention member 103 attached to the contact 101. The contact 101 has a held portion 104 and a main portion 105. The held portion 104 is held by the holding member 102. The main portion 105 roughly has a tubular shape and extends from the held portion 104 in a predetermined direction (PD). As shown in FIG. 29(*b*), the main portion 105 is formed with holes 106, each of which pierces the main portion 105 in a radius direction perpendicular to the predetermined direction. The contact prevention member 103 has a head portion 107, a shaft portion 108 and resilient portions 109. The head portion 107 is larger than an inner shape of the main portion 105. The shaft portion 108 has a shape corresponding to the inner shape of the main portion 105. Each of the resilient portions 109 extends from the shaft portion 108. An end of each resilient portion 109 is formed with an engagement portion 110 which projects outwards beyond the shaft portion 108 in the radius direction. When the contact prevention member 103 is inserted into the contact 101, the engagement portions 110 of the contact prevention member 103 are engaged with the holes 106 of the main portion 105. Thus, the contact prevention member 103 is attached to the contact 101. The head portion 107 of the contact prevention member 103 projects over the tip of the contact 101 and prevents a finger 111 of a user from being in contact with the tip of the contact 101.

The contact sometimes receives a force obliquely to the predetermined direction when the connector is mated with a mating connector. The connector of JP 3,575,295B has a problem that the contact might buckle when the contact receives the oblique force.

SUMMARY OF THE INVENTION

It is an object of the present invention to provide a connector with a structure which prevents a finger of a user from being in contact with a tip of a contact and according to which the contact buckles hardly even if the contact receives oblique force.

One aspect of the present invention provides a connector which is mateable with a mating connector along a predetermined direction (PD). The connector comprises a holding member, a plurality of contacts and a plurality of contact prevention members. The holding member includes a holding portion. The plurality of contacts include held portions and main portions, respectively. The held portions are held by the holding portion. The main portions extend from the held portions, respectively, in the predetermined direction. The main portions project over the holding portion in the predetermined direction. Each of the main portions has a tubular shape. Each of the contact prevention members is made of insulator. The contact prevention members occupy insides of the main portions, respectively. The contact prevention members project over the main portions, respectively, in the predetermined direction.

The contact prevention member occupies the inside of the main portion and projects over the main portion. Since the contact prevention member projects over the main portion, a finger of a user can be prevented from being in contact with the tip of the contact. Since the main portion is reinforced from inside thereof by the contact prevention member, the contact buckles hardly.

An appreciation of the objectives of the present invention and a more complete understanding of its structure may be had by studying the following description of the preferred embodiment and by referring to the accompanying drawings.

BRIEF DESCRIPTION OF THE DRAWINGS

FIG. 29 (*a*) is a cross-sectional view showing the connector. FIG. 29 (*b*) is an enlarged, cross-sectional view showing the contact and the contact prevention member of FIG. 29 (*a*).

Figure 1:
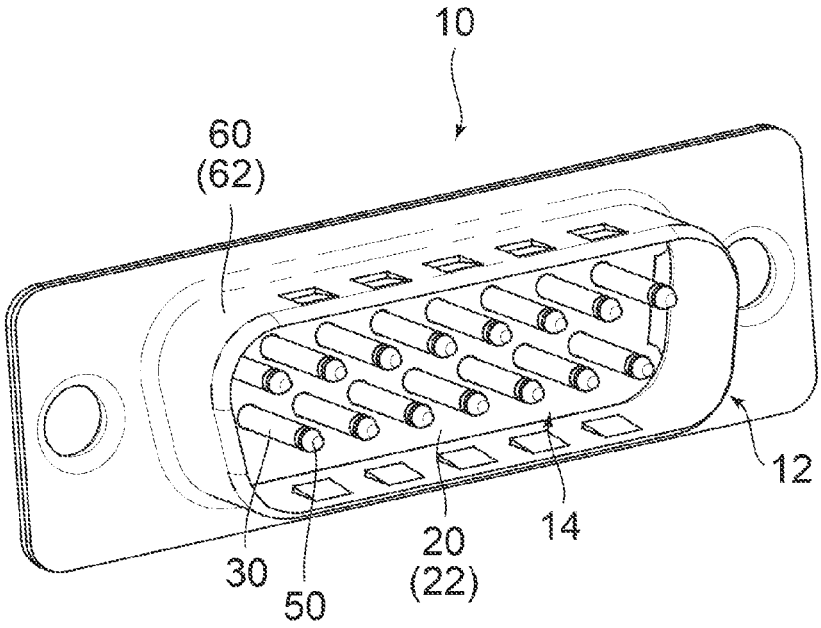
FIG. 1 is a perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
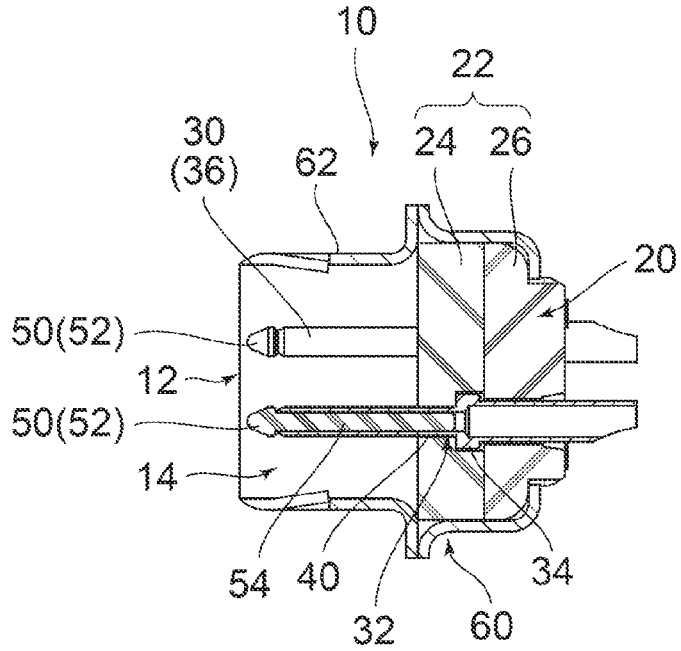
FIG. 2 is a cross-sectional view showing the connector of FIG. 1.
Figure 2:
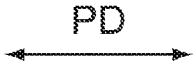

Referring to FIGS. 1 and 2, a connector 10 according to a first embodiment of the present invention is mateable with a mating connector (not shown) along a predetermined direction (front-rear direction, PD). The connector 10 has a mating end 12 and a receiving portion 14. The mating end 12 is mateable with the mating connector. The receiving portion 14 receives a part of the mating connector. The mating end 12 is positioned at a front end of the connector 10. The receiving portion 14 is positioned rearward of the mating end 12. Specifically, the receiving portion 14 is recessed rearward from the mating end 12.

The illustrated connector 10 comprises a holding member 20, a plurality of contacts 30, a plurality of contact prevention members 50 and a shell 60. The holding member 20 is made of insulator. Each of the contacts 30 is made of conductor. Each of the contact prevention members 50 is made of insulator. The shell 60 is made of metal.

As shown in FIG. 2, the holding member 20 includes a holding portion 22 which consists of two blocks, a front block 24 and a rear block 26. The holding portion 22 may consist of one block.

Figure 3:
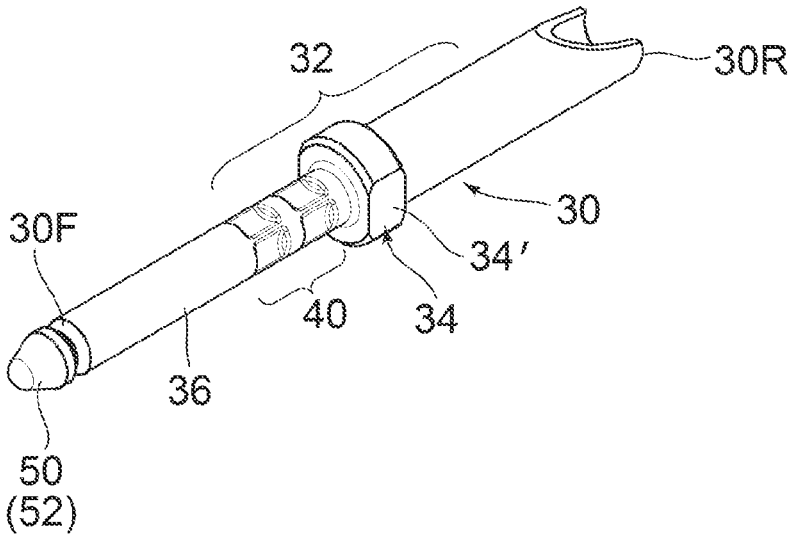
FIG. 3 is a perspective view showing a contact and a contact prevention member which are included in the connector of FIG. 1.
Figure 4:
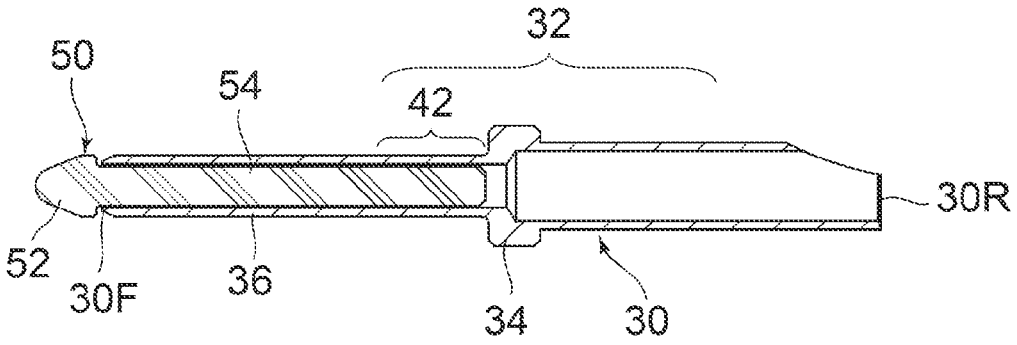
FIG. 4 is a cross-sectional view showing the contact and the contact prevention member of FIG. 3. The contact is not yet formed with a crimped portion.

As shown in FIGS. 1 to 4, each of the contacts 30 includes a held portion 32 and a main portion 36. The held portion 32 is held by the holding portion 22. The main portion 36 projects over the held portion 32 in the predetermined direction. In detail, the main portion 36 of the present embodiment extends frontward so as to project over the holding portion 22 in the predetermined direction. As shown in FIGS. 2 to 4, the held portion 32 is formed with a stopper portion 34 projecting in a radial direction. In the present embodiment, the stopper portion 34 is caught by the front block 24 and the rear block 26 as shown in FIG. 2, so that the held portion 32 is held by the holding portion 22. Furthermore, the stopper portion 34 is provided with a plane portion 34', so that the contact 30 can be prevented from being rotated. The main portion 36 has a tubular shape. Especially, the main portion 36 of the present embodiment has a cross-sectional shape uniform in a plane perpendicular to the predetermined direction.

The main portion 36 of the contact 30 is a part which is connected to a mating contact (not shown) of the mating connector (not shown). On the other hand, a rear part (including the held portion 32) of the contact 30 is a connection portion which is connected to a signal line. Although the main portion 36 of the present embodiment has a cylindrical tubular shape, the present invention is not limited thereto. Depending upon a shape or the like of the mating contact (not shown) of the mating connector (not shown), the main portion 36 may have a square tubular shape. In addition, as understood from FIG. 4, each of the contacts 30 of the present embodiment has a hollow structure in which a hole pierces it from its front end 30F to its rear end 30R. However, the present invention is not limited thereto. For example, each of the contacts 30 may have a partition wall which separates the main portion 36 from the connection portion (the rear part of the contact 30).

Unlike the connector of JP 3,575,295B, each of the main portions 36 of the present embodiment is formed with no hole which connects between an inside and an outside of the main portion 36, as understood from FIGS. 3 and 4. Accordingly, when the signal line is connected to the contact 30 by soldering, molten solder flowing through an inside of the connection portion cannot flow out to an outer surface of the main portion 36 as a contact portion which connects the mating contact (not shown). Although each of the contacts 30 of the present embodiment is formed with no hole which connects between the outside and the inside thereof, each of the connection portions of the contacts 30 may be formed with the hole if each of the main portions 36 of the contacts 30 is formed with no hole.

Figure 5:
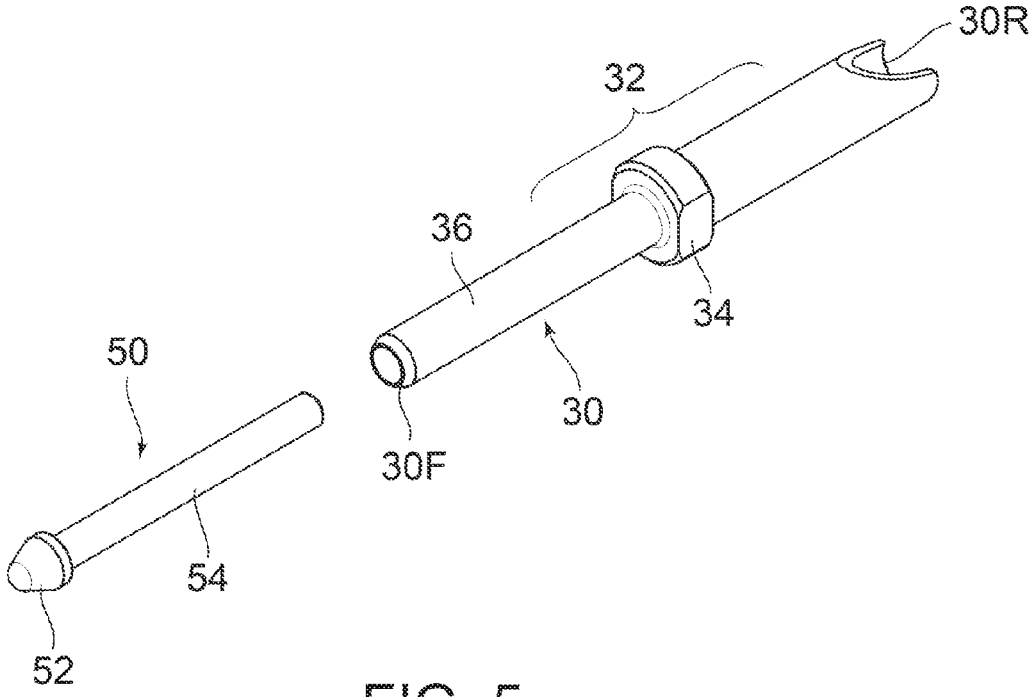
FIG. 5 is a perspective view showing a state before assembling the contact and the contact prevention member of FIG. 3.

As shown in FIGS. 4 and 5, each of the contact prevention members 50 of the present embodiment has a head portion 52 and a shaft portion 54. The shaft portion 54 extends along the predetermined direction (front-rear direction). Except a portion which is crimped to be deformed as described later, the shaft portion 54 has a bar-like shape having a size uniform in the plane perpendicular to the predetermined direction. The head portion 52 is formed at a front end of the shaft portion 54. The head portion 52 has a shape (large shape portion) larger than the shaft portion 54 in the plane perpendicular to the predetermined direction. In detail, as understood from FIGS. 3 and 4, a maximum size of the head portion 52 is almost same as an outer peripheral size of the main portion 36. Specifically, the head portions (large shape portions) 52 project outwards beyond shapes which are defined by inner walls of the main portions 36 in the plane perpendicular to the predetermined direction, respectively. The shaft portions 54 are accommodated in the contacts 30, respectively. The head portions 52 project frontward from the front ends 30F of the main portions 36, respectively.

As best illustrated in FIG. 3, each of parts of the contacts 30 is crimped to be formed with crimped portions 40, so that the contact prevention members 50 of the present embodiment are attached to the contacts 30, respectively. In detail, as understood from FIGS. 5 and 6, the shaft portions 54 are inserted from the front ends 30F of the contacts 30 into the main portions 36, respectively, and regions 42 are then crimped to be deformed, so that the crimped portions 40 are formed (see FIG. 3). By the formation of the crimped portions 40, parts of the shaft portions 54 are deformed so as to occupy inside of the crimped portions 40, respectively. Accordingly, the contact prevention members 50 are held by the contacts 30, respectively.

Figure 6:
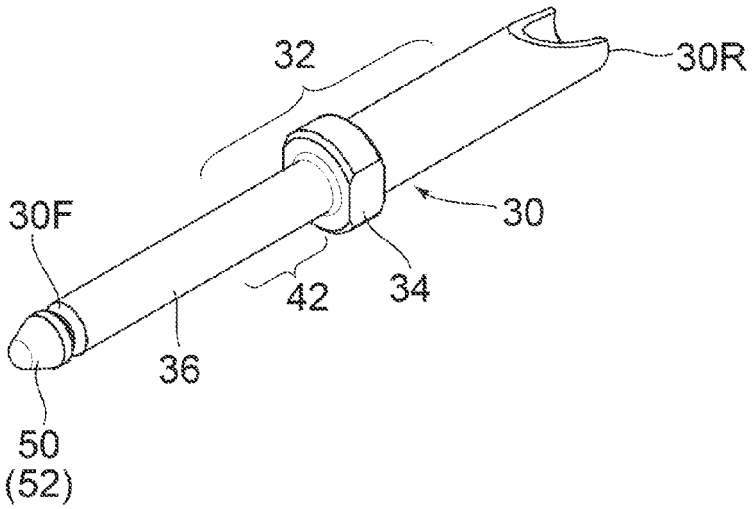
FIG. 6 is a perspective view showing the contact and the contact prevention member of FIG. 5. The contact prevention member is inserted into the contact. The contact is not yet formed with the crimped portion.

As understood from FIGS. 5 and 6, each of the contact prevention members 50 of the present embodiment is provided with the large shape portion (head portion 52), which is larger than the shaft portion 54, only at one end of the shaft portion 54. Accordingly, when the shaft portions 54 are inserted into the main portions 36, respectively, unnecessary loads are not applied to the contact prevention members 50 and the contacts 30, respectively, so that unintended deformations of the contact prevention members 50 and the contacts 30 can be prevented.

In addition, as understood from FIGS. 2 and 4, the shaft portions 54 of the contact prevention members 50 occupy insides of the main portions 36, respectively. In other words, insides of the main portions 36 of the contacts 30 are reinforced by the shaft portions 54, respectively. Thus, the contacts 30 of the present embodiment buckle hardly.

As understood from FIGS. 2 and 3, each of the crimped portions 40 of the present embodiment is formed on the held portions 32. Accordingly, as shown in FIG. 1, the crimped portions 40 are not exposed in the receiving portion 14. Since each of the main portions 36 has a uniform shape as shown in FIGS. 2 and 3, the contacts 30 of the present embodiment buckle hardly. However, the present invention is not limited thereto. Each of the crimped portions 40 may be formed so as to extend over from the held portion 32 to the main portion 36. In other words, each crimped portion 40 may be formed to bridge the held portion 32 and the main portion 36.

As shown in FIGS. 1 and 2, the shell 60 partly covers the holding member 20. The shell 60 has a surrounding portion 62 which surrounds the main portions 36 of the plurality of contacts 30 altogether in the plane perpendicular to the predetermined direction. The surrounding portion 62 of the present embodiment defines the receiving portion 14 while an end of the surrounding portion 62 forms the mating end 12. Although the surrounding portion 62 is formed as a part of the shell 60 in the present embodiment, the surrounding portion 62 may be formed as a part of the holding member 20. The surrounding portion 62 may be provided on both the holding member 20 and the shell 60.

Figure 20:
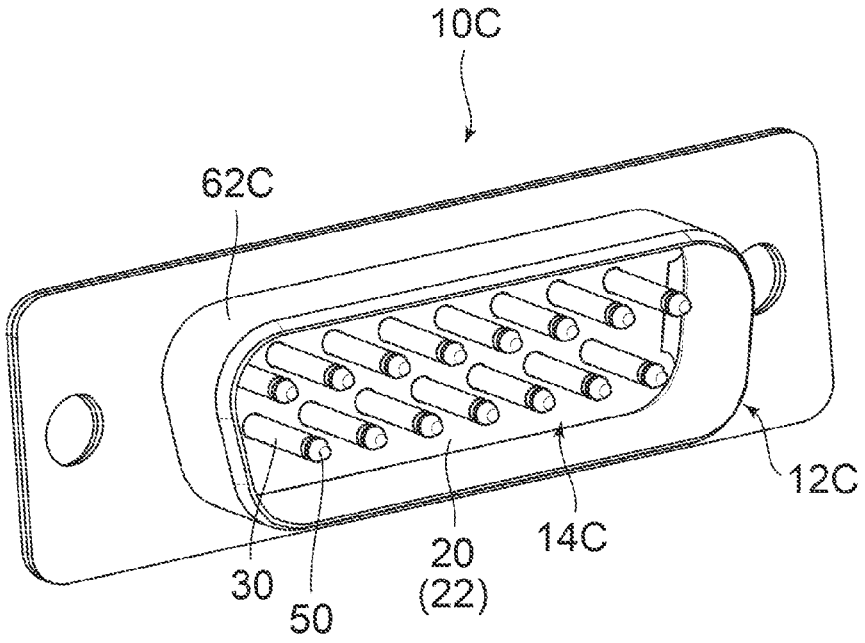
FIG. 20 is a perspective view showing a connector according to a modification in which a surrounding portion of the connector of FIG. 1 is formed of an insulator.
Figure 21:
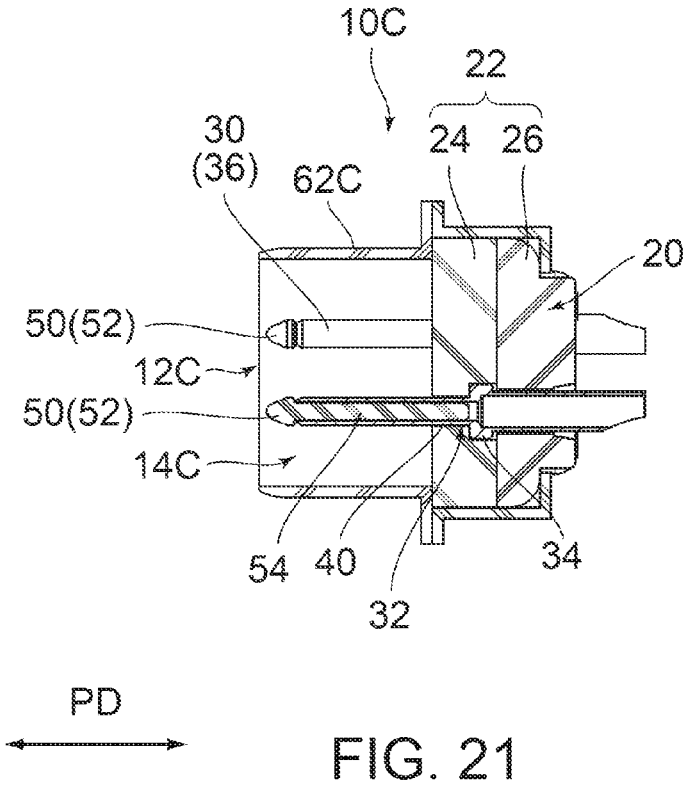
FIG. 21 is a cross-sectional view showing the connector of FIG. 20.

For example, with reference to FIGS. 20 and 21, a variation of the connector 10C comprises, instead of the shell 60 of the above-described embodiment, a surrounding portion 62C made of insulator. Specifically, the connector 10C comprises the plurality of contacts 30, the holding member 20, the surrounding portion 62C made of insulator. Each of the contacts 30 has a structure same as the contact 30 of the above-described embodiment and is held by the holding member 20 as described above. The surrounding portion 62C surrounds the main portions 36 of the plurality of contacts 30 altogether in the plane perpendicular to the predetermined direction. As understood from FIGS. 1 and 20, similar to the surrounding portion 62 of the above-described embodiment, the surrounding portion 62C of the present embodiment defines a receiving portion 14C and an end of the surrounding portion 62C forms a mating end 12C. Specifically, similar to the receiving portion 14 of the above-described embodiment, the main portions 36 of the contacts 30 are positioned in the receiving portion 14C which is defined by the surrounding portion 62C of this variation. In addition, the surrounding portion 62C may be formed integrally with the holding member 20.

Figure 7:
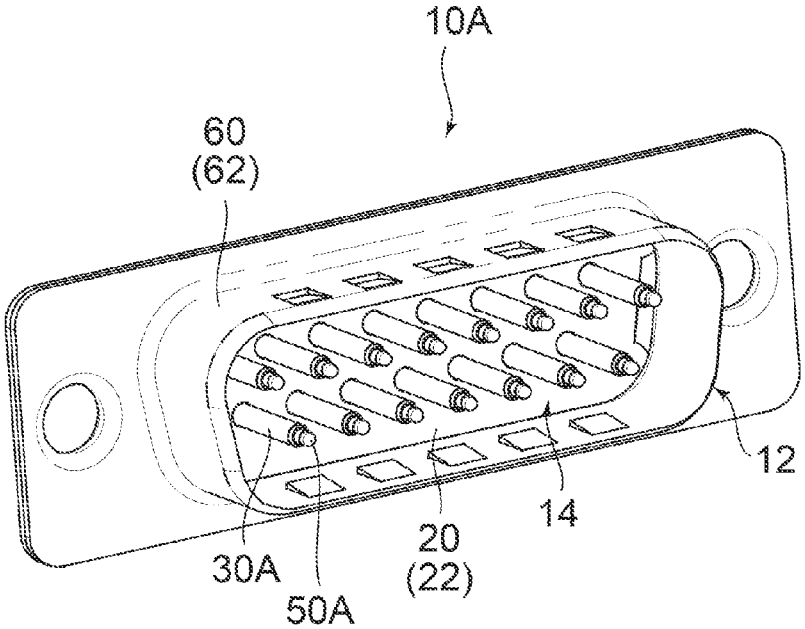
FIG. 7 is a perspective view showing a connector according to a second embodiment of the present invention.
Figure 8:
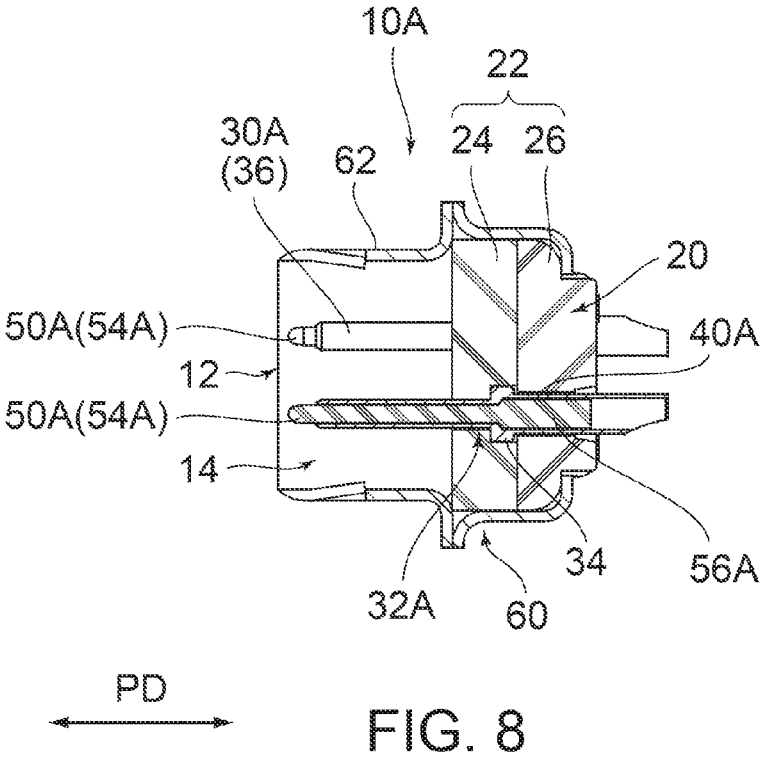
FIG. 8 is a cross-sectional view showing the connector of FIG. 7.

With reference to FIGS. 7 and 8, a connector 10A according to a second embodiment of the present invention is a variation example of the connector 10 of the above-described first embodiment. In FIGS. 7 and 8, components which are same as those of the connector 10 shown in FIGS. 1 and 2 are referred by using reference signs same as those of the connector 10. As understood from FIGS. 7 and 8, the holding member 20 and the shell 60 of the present embodiment are same as the holding member 20 and the shell 60 of the first embodiment. Accordingly, detailed explanation about those components is not made. With reference to FIGS. 5 and 11, each of contacts 30A which is not yet crimped has a structure same as the contact 30 of the first embodiment which is not yet crimped. Accordingly, with reference to FIGS. 9 to 12, a structure of a contact prevention member 50A and an attachment method of the contact prevention member 50A to the contact 30A are mainly described below.

Figure 10:
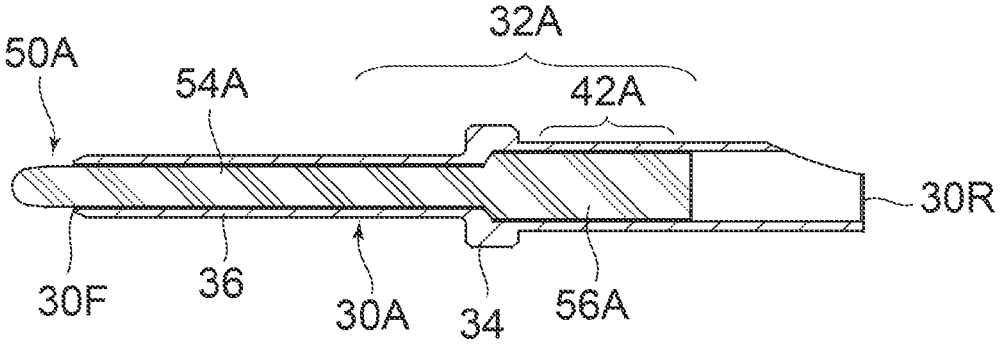
FIG. 10 is a cross-sectional view showing the contact and the contact prevention member of FIG. 9. The contact is not yet formed with the crimped portion.
Figure 11:
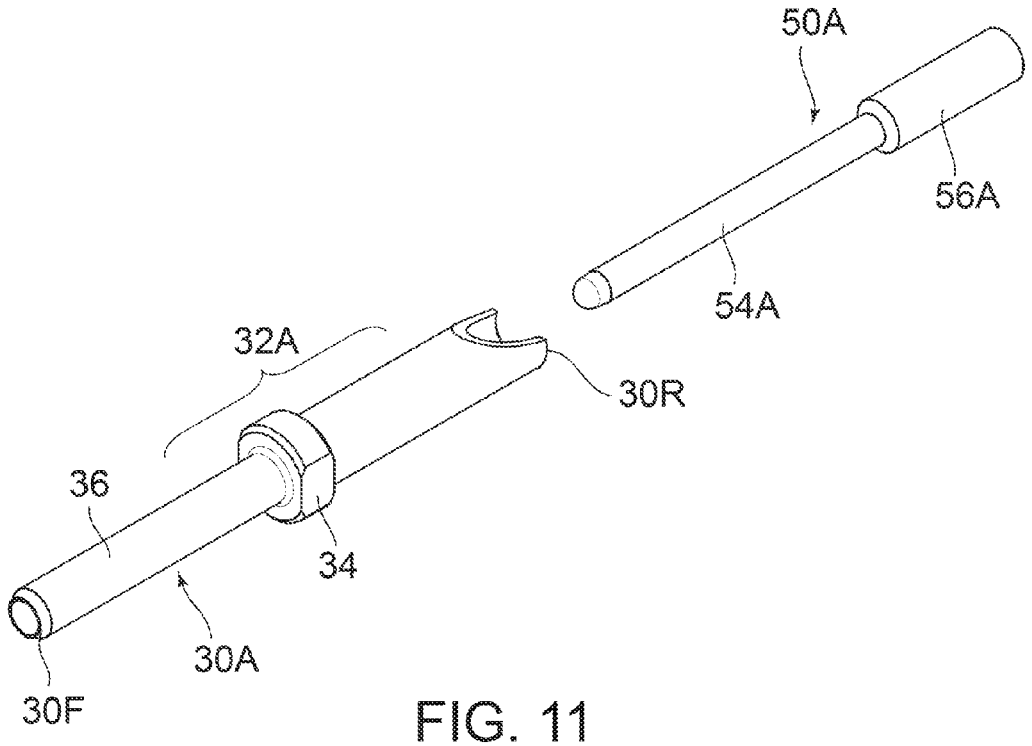
FIG. 11 is a perspective view showing a state before assembling the contact and the contact prevention member of FIG. 9.

As shown in FIGS. 10 and 11, each of the contact prevention members 50A of the present embodiment has a shaft portion 54A and a large shape portion 56A. The shaft portion 54A extends along the predetermined direction (front-rear direction). The shaft portion 54A has a length longer than the shaft portion 54 of the above-described first embodiment in the predetermined direction. The shaft portion 54A has a bar-like shape having a size uniform in the plane perpendicular to the predetermined direction. Parts of the shaft portions 54A of the present embodiment project from the front ends 30F of the contacts 30A, respectively. The remaining parts of the shaft portions 54A of the present embodiment are accommodated in the contacts 30A, respectively. The large shape portion 56A is provided on a rear end of the shaft portion 54A. The large shape portion 56A has a shape larger than the shaft portion 54A in the plane perpendicular to the predetermined direction. The large shape portions 56A are accommodated in the contacts 30A, respectively.

Figure 9:
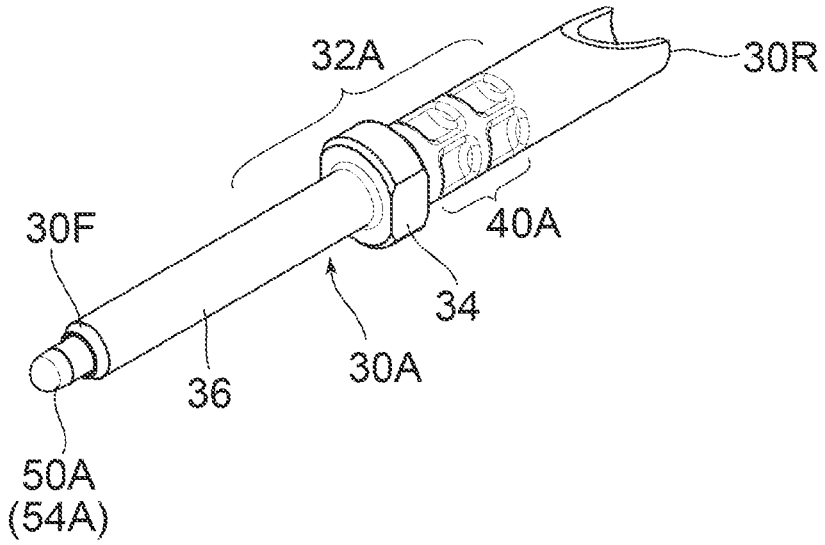
FIG. 9 is a perspective view showing a contact and a contact prevention member which are included in the connector of FIG. 7.

As best illustrated in FIG. 9, each of parts of the contacts 30A is crimped to be formed with a crimped portion 40A, so that contact prevention members 50A of the present embodiment are attached to the contacts 30A, respectively. In detail, as understood from FIGS. 11 and 12, the shaft portions 54A are inserted from the rear ends 30R of the contacts 30A into the main portions 36, respectively, and regions 42A are then crimped to be deformed, so that the crimped portions 40A are formed (see FIG. 9). By the formation of the crimped portions 40A, parts of the large shape portion 56A are deformed to occupy insides of the crimped portions 40A, respectively, so that the contact prevention members 50A are held by the contacts 30A, respectively. In addition, as shown in FIG. 3 of the first embodiment, each of the crimped portions 40A may be formed at a part which is positioned frontward of the stopper portion 34.

Figure 12:
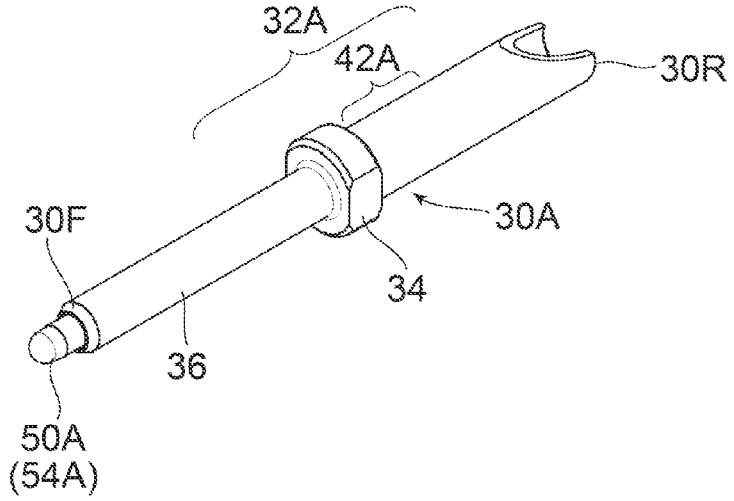
FIG. 12 is a perspective view showing the contact and the contact prevention member of FIG. 11. The contact prevention member is inserted into the contact. The contact is not yet formed with the crimped portion.

As understood from FIGS. 11 and 12, each of the contact prevention members 50A of the present embodiment is provided with the large shape portion 56A, which is larger than the shaft portion 54A, only at one end of the shaft portion 54A. Accordingly, when the shaft portions 54A are inserted into the contacts 30A, respectively, unnecessary loads are not applied to the contact prevention members 50A and the contacts 30A, respectively, so that unintended deformations of the contact prevention members 50A and the contacts 30A can be prevented.

In addition, as understood from FIGS. 8 and 10, the shaft portions 54A of the contact prevention members 50A occupy insides of the main portions 36 of the contacts 30A, respectively. In other words, insides of the main portions 36 of the contacts 30A are reinforced by the shaft portions 54A, respectively. Thus, the contacts 30A of the present embodiment buckle hardly.

As understood from FIGS. 8 and 9, each of the crimped portions 40A of the present embodiment is formed on the held portion 32A. Each of the main portions 36 of the present embodiment has a uniform shape. Accordingly, the contacts 30A of the present embodiment buckle hardly.

In the above-described first and second embodiment, the contacts 30, 30A are formed by cutting and the like. However, the present invention is not limited thereto. For example, in a third embodiment, each of contacts may be formed cylindrically by rolling a blank which is obtained by pressing a metal plate. The third embodiment is described below.

Figure 13:
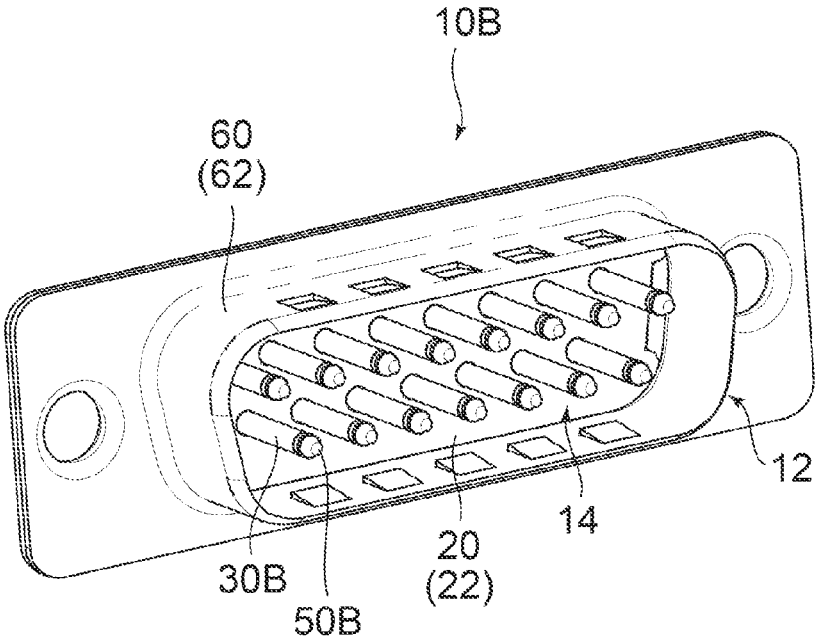
FIG. 13 is a perspective view showing a connector according to a third embodiment of the present invention.
Figure 14:
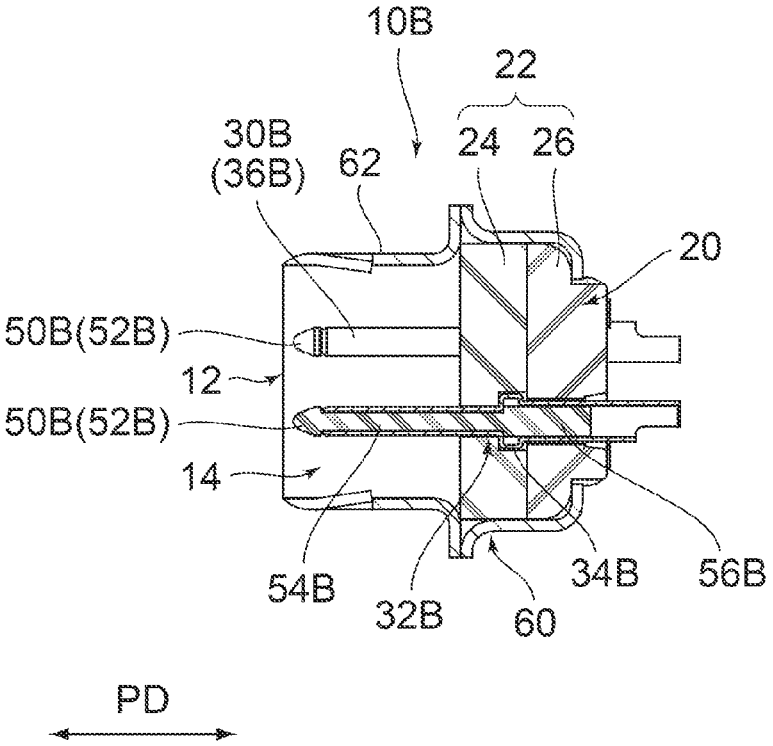
FIG. 14 is a cross-sectional view showing the connector of FIG. 13.

With reference to FIGS. 13 and 14, a connector 10B according to the third embodiment of the present invention is a variation example of the connector 10 of the above-described first embodiment. In FIGS. 13 and 14, the portions which are same as those of the connector 10 shown in FIGS. 1 and 2 are referred by using reference signs same as those of the connector 10. As understood from FIGS. 13 and 14, the holding member 20 and the shell 60 of the present embodiment are same as the holding member 20 and the shell 60 of the first embodiment. Accordingly, detailed explanation about those portions is not made.

Figure 15:
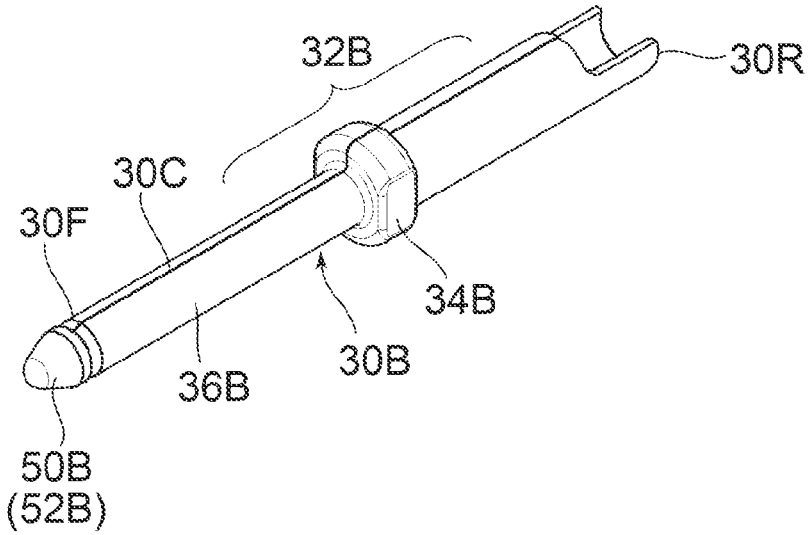
FIG. 15 is a perspective view showing a contact and a contact prevention member which are included in the connector of FIG. 13.
Figure 16:
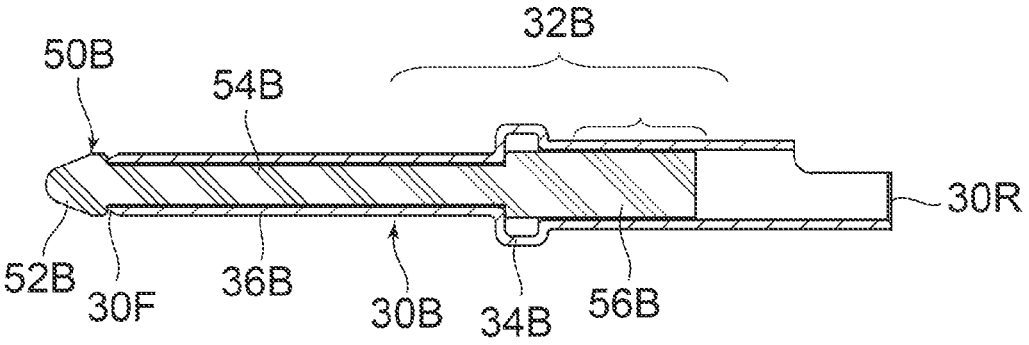
FIG. 16 is a cross-sectional view showing the contact and the contact prevention member of FIG. 15. The contact is not yet formed with the crimped portion.

Although, as understood from FIGS. 14 to 16, a main function of contacts 30B is same as the above-described contacts 30, 30A, a manufacturing method of the contacts 30B is different from those of the contacts 30, 30A. Because of the difference of the manufacturing methods, a structural detail of each of the contacts 30B is different from those of the contacts 30, 30A.

As understood from FIGS. 15 to 19, the contacts 30B of the present embodiment are formed by winding intermediate members 70, which are obtained by pressing metal plates, around contact prevention members 50B, respectively. The intermediate members 70 are wound around the contact prevention members 50B, respectively, so that the contact prevention members 50B are held by the contacts 30B, respectively.

Figure 17:
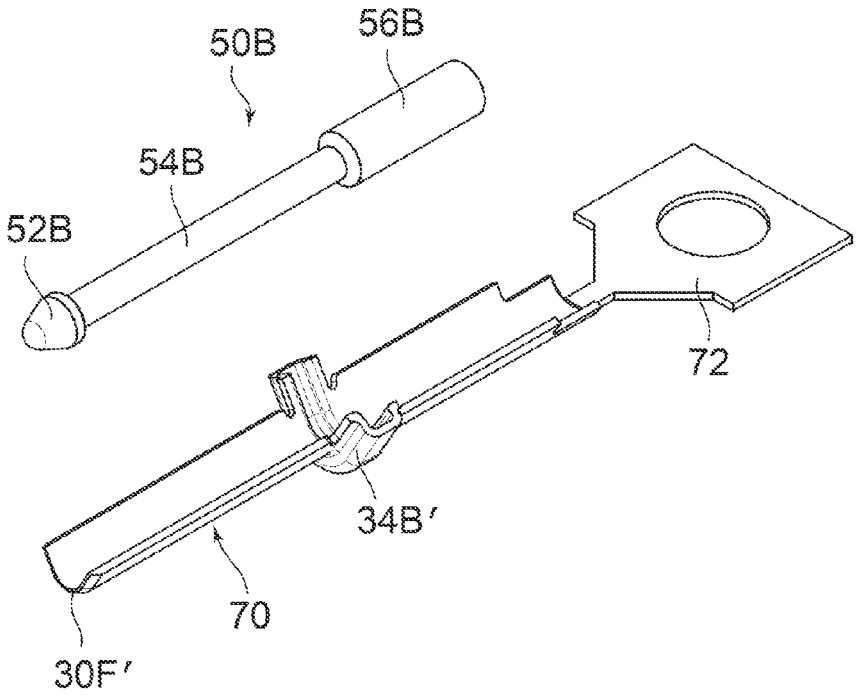
FIG. 17 is a perspective view showing a state before assembling the contact and the contact prevention member of FIG. 15. The contact is in a state of an intermediate member.
Figure 18:
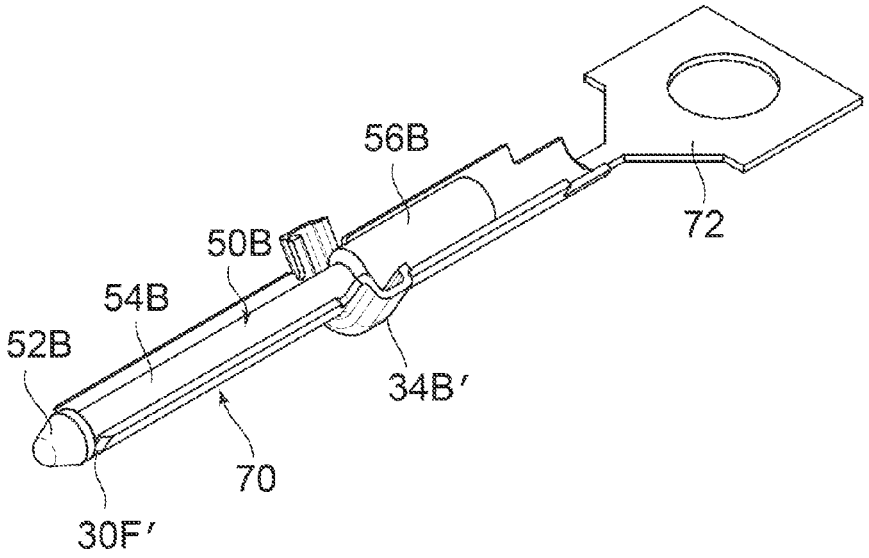
FIG. 18 is a perspective view showing the intermediate member and the contact prevention member of FIG. 17. The contact prevention member is mounted on the intermediate member.

With reference to FIGS. 16 to 18, each of the contact prevention members 50B of the present embodiment has a structure which has both features of the contact prevention member 50B and the contact prevention member 50A as described above. Each of the contact prevention members 50B has a head portion (large shape portion) 52B, a shaft portion 54B and a large shape portion 56B. The head portion 52B corresponds to the head portion 52 of the contact prevention member 50B of the first embodiment. The head portion 52B is positioned frontward of the shaft portion 54B. The large shape portion 56B corresponds to the large shape portion 56A of the contact prevention member 50A of the second embodiment. The large shape portion 56B is positioned rearward of the shaft portion 54B. Specifically, in the predetermined direction, each of the contact prevention members 50B of the present embodiment has the large shape portion 52B on one end of the shaft portion 54B and the large shape portion 56B on the other end thereof. The large shape portions 52B and 56B have shapes each of which is larger than a shape of the shaft portion 54B in the plane perpendicular to the predetermined direction.

Figure 19:
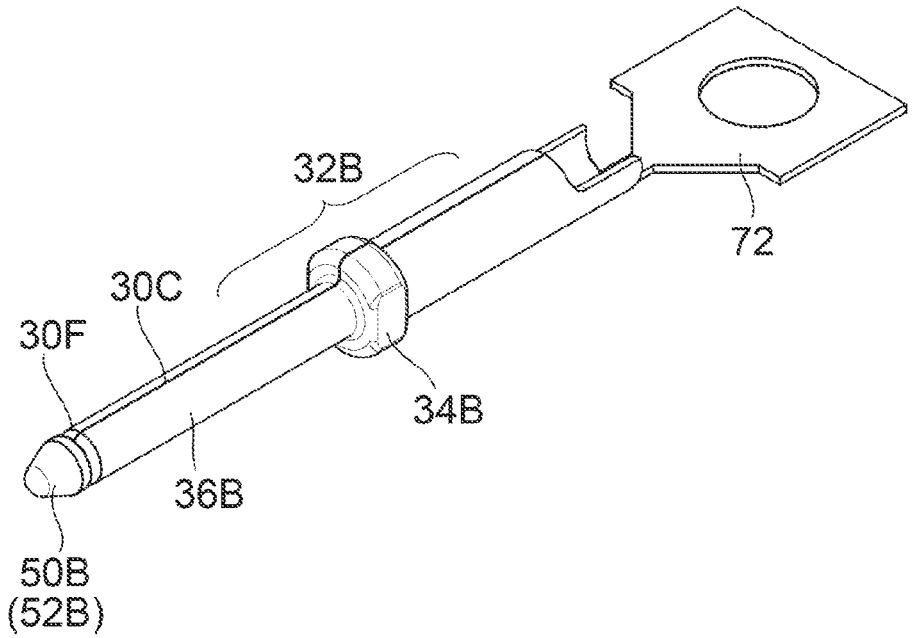
FIG. 19 is a perspective view showing the intermediate member and the contact prevention member of FIG. 18. The intermediate member is wound on the contact prevention member.

As shown in FIG. 17, each of the intermediate members 70 is formed with a portion 34B' which becomes a stopper portion 34B. The illustrated intermediate member 70 is under a state where the intermediate member 70 is connected to a carrier 72. As shown in FIG. 18, the contact prevention members 50B are mounted on the intermediate members 70 so that the head portions 52B project from front ends 30F' of the intermediate members 70, respectively, and that the large shape portions 56B extend rearward from the portions 34B', respectively. Specifically, the contact prevention members 50B are mounted on the intermediate members 70 so that the shaft portions 54B are positioned between the front ends 30F' and the portions 34B', respectively. Next, as shown in FIG. 19, the intermediate members 70 are wound around the contact prevention members 50B, respectively. Thus, the contact prevention members 50B are held by the contacts 30B, respectively. After that, the carriers 72 are separated from the contacts 30B, respectively, so that the contact 30B and the contact prevention member 50B as shown in FIG. 15 are obtained.

By the above-described manufacturing method, each of the contacts 30B has a joint 30C. As shown in FIG. 16, the shaft portions 54B of the contact prevention members 50B occupy insides of the main portions 36B, respectively, and each of the contacts 30B is formed with no hole which connects between an inside and an outside thereof. Accordingly, similar to the first embodiment and the second embodiment, molten solder cannot flow out to an outer surface of the contact 30B when the signal line is connected to the contact 30B by soldering. In addition, in the present embodiment, each of the connection portions of the contacts 30B may be formed with the hole if each of the main portions 36B of the contacts 30B is not formed with the hole.

With reference to FIG. 16, a space exists between the stopper portion 34B and the large shape portion 56B of the present embodiment. As shown in FIG. 14, the stopper portion 34B is a part of the held portion 32B which is held by the holding portion 22. Thus, the contacts 30B buckle hardly even if the spaces exist. However, the present invention is not limited thereto. Each of the contact prevention members 50B may be modified so that each of the spaces does not exist between the stopper portion 34B and the contact prevention member 50B.

By the above-described manufacturing method, the large shape portions 52B and 56B having shapes each of which is larger than an inner shape of the main portion 36B can be provided at opposite ends of the tubular main portion 36B, respectively. Accordingly, the contact prevention member 50B are prevented from coming off from the contacts 30B, respectively.

In the present embodiment, each of the contact prevention members 50B having a size slightly larger than a normal size may be pressed to be compressed and deformed when the intermediate member 70 is wound therearound. In that case, the contacts 30B are engaged with the surface of the contact prevention members 50B by winding the intermediate members 70, respectively, so that the contact prevention members 50B are held by the contacts 30B, respectively. Accordingly, at least one of the head portion 52B and the large shape portion 56B can be omitted. In addition, similar to the first and second embodiment, at least one of the crimped portions 40, 40A may be formed on the contact 30B.

Figure 22:
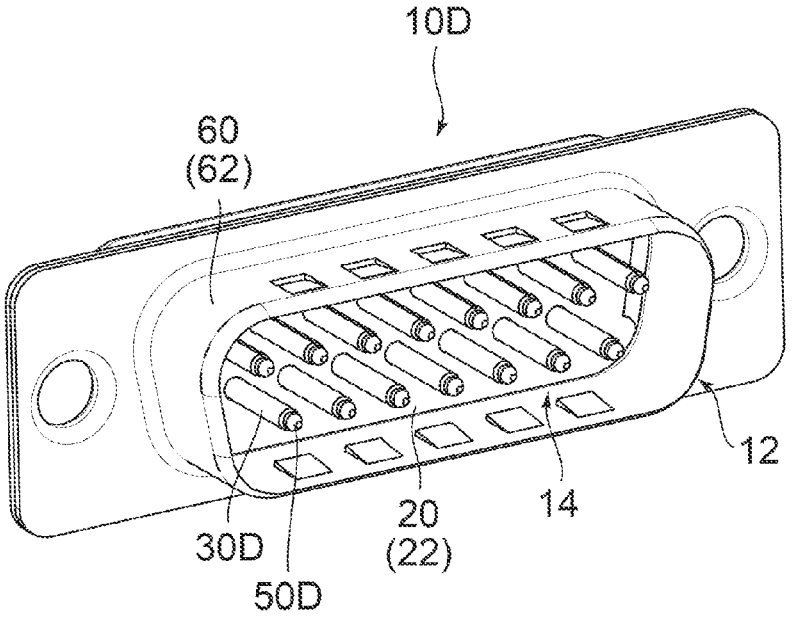
FIG. 22 is a perspective view showing a connector according to a fourth embodiment of the present invention.
Figure 23:
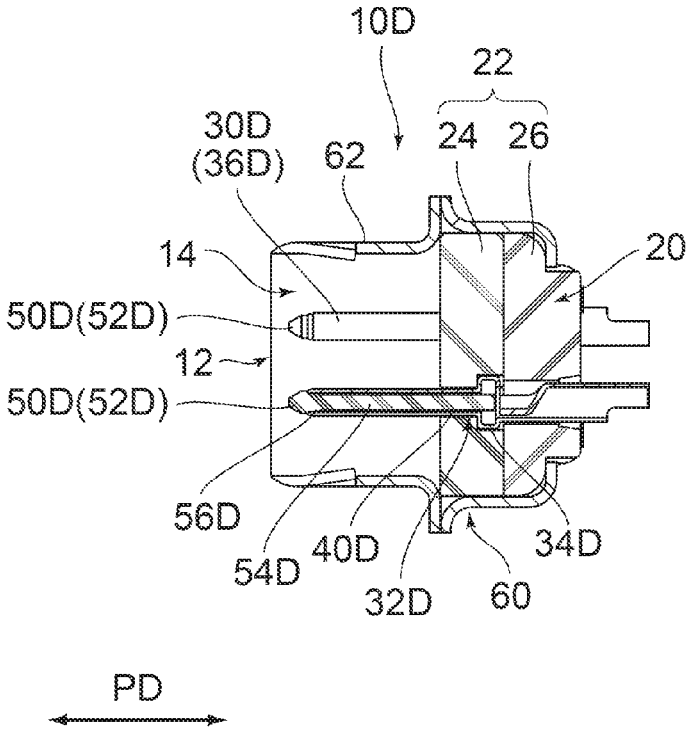
FIG. 23 is a cross-sectional view showing the connector of FIG. 22.

With reference to FIGS. 22 and 23, the connector 10D according to a fourth embodiment of the present invention is a variation example of the connector 10 of the above-described first embodiment. In FIGS. 22 and 23, components which are same as those of the connector 10 shown in FIGS. 1 and 2 are referred by using reference signs same as those of the connector 10. As understood from FIGS. 22 and 23, the holding member 20 and the shell 60 of the present embodiment are same as the holding member 20 and the shell 60 of the first embodiment. Accordingly, detailed explanation about those components is not made.

Figure 24:
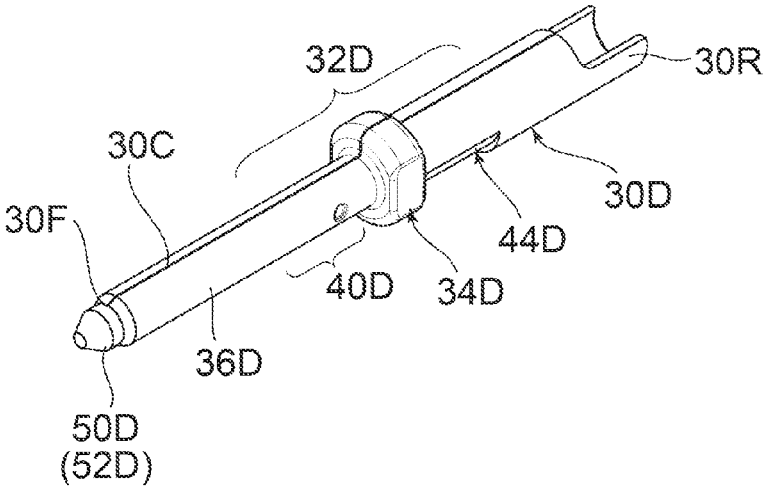
FIG. 24 is a perspective view showing a contact and a contact prevention member which are included in the connector of FIG. 22.
Figure 25:
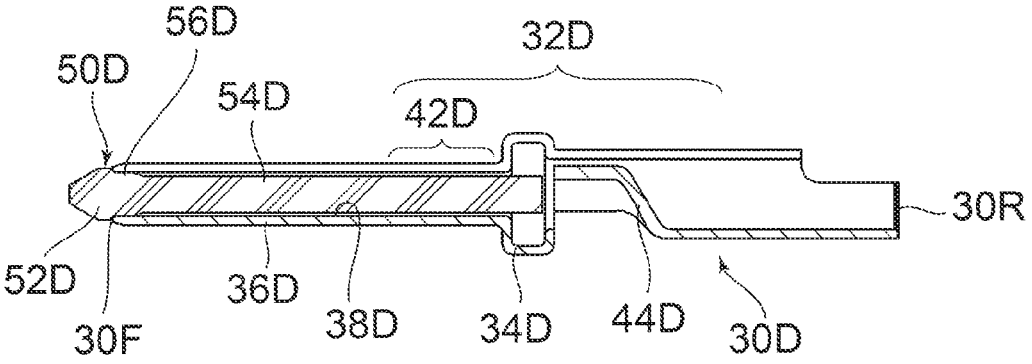
FIG. 25 is a cross-sectional view showing the contact and the contact prevention member of FIG. 24.

As understood from FIGS. 24 and 25, each of the contacts 30D of the present embodiment is obtained by pressing a metal plate followed by bending it. Each of the contacts 30D of the present embodiment has a joint 30C similar to the contact 30B (see FIG. 15) of the above-described embodiment. However, the present invention is not limited thereto. Each of the contacts 30D may be formed by cutting and the like.

Specifically, as shown in FIGS. 24 and 25, each of the contacts 30D has a held portion 32D and a main portion 36D. The held portion 32D is held by the holding portion 22. The main portion 36D extends from the held portion 32D in the predetermined direction. In detail, the main portion 36D of the present embodiment extends frontward so as to project over the holding portion 22 in the predetermined direction. As shown in FIGS. 23 to 25, the held portion 32D is formed with a stopper portion 34D projecting in the radial direction. In the present embodiment, as shown in FIG. 23, the stopper portion 34D is caught by the front block 24 and the rear block 26 as shown in FIG. 23, so that the held portion 32D is held by the holding portion 22. The main portion 36D has a tubular shape. Except a portion which is crimped to be deformed as described later, the main portion 36D of the present embodiment has a cross-sectional shape uniform in the plane perpendicular to the predetermined direction. As best illustrated in FIG. 25, each of the contacts 30D is formed with a partition portion 44D which separates solder from the contact prevention member 50D so that the solder is prevented from being adhered to the contact prevention member 50D when the signal line is connected to the contact 30D by soldering. Each of the contact prevention members 50D is described later. In the present embodiment, the partition portion 44D is positioned rearward of the stopper portion 34D.

Figure 26:
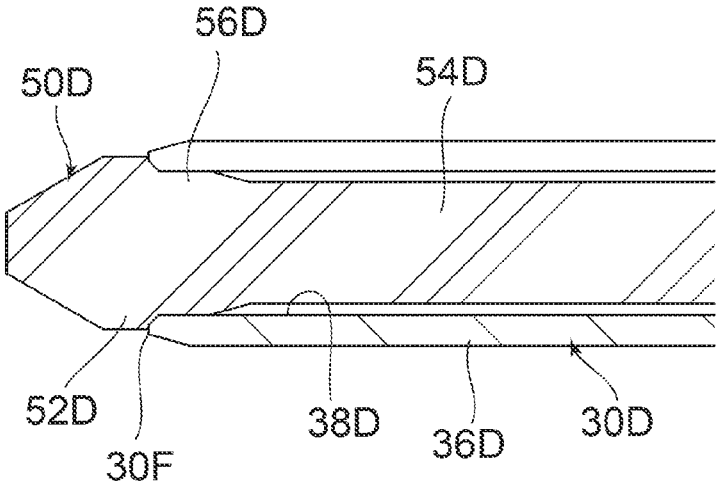
FIG. 26 is an enlarged, cross-sectional view showing a tip of the contact and the contact prevention member of FIG. 25.

As shown in FIGS. 25 and 26, each of the contact prevention members 50D of the present embodiment has a head portion (large shape portion) 52D, an inner fit portion 56D and a shaft portion 54D. The shaft portion 54D extends along the predetermined direction (front-rear direction). Except a portion which is crimped to be deformed as described later, the shaft portion 54D has a bar-like shape having a size uniform in the plane perpendicular to the predetermined direction. Especially, in the plane (perpendicular plane) perpendicular to the predetermined direction, the shaft portion 54D of the present embodiment has a size smaller than a shape which is defined by an inner wall 38D of the main portion 36D of the contact 30D. Accordingly, as shown in FIG. 26, a slight space exists between the inner wall 38D of the main portion 36D and the shaft portion 54D, and the shaft portion 54D is not closely fit on the inner wall 38D. The inner fit portion 56D is provided on a front end of the shaft portion 54D. The inner fit portion 56D has a size larger than the shaft portion 54D in the perpendicular plane. In other words, the shaft portion 54D has a size smaller than the inner fit portion 56D in the perpendicular plane. Specifically, the inner fit portion 56D is closely fit on the whole inner wall 38D of the main portion 36D in the perpendicular plane. The head portion 52D is provided on a front end of the inner fit portion 56D. Specifically, the inner fit portion 56D is positioned between the head portion 52D and the shaft portion 54D in the predetermined direction. The head portion 52D of the present embodiment is in contact with the main portion 36D without any gaps in the predetermined direction. In other words, the head portion 52D is in contact with a whole circumference of an end of the main portion 36D. Furthermore, the head portion 52D has a size larger than the inner fit portion 56D in the perpendicular plane. Specifically, the head portion 52D has a size larger than the shaft portion 54D in the perpendicular plane. In detail, as understood from FIGS. 25 and 26, the head portion (large shape portion) 52D projects outwards beyond a shape which is defined by the inner wall 38D of the main portion 36D in the perpendicular plane. The inner fit portion 56D and the shaft portion 54D are accommodated in the contact 30D. The head portion 52D projects frontward from the front end 30F of the main portion 36D.

In the present embodiment, the shaft portion 54D has the bar-like shape having a cross-sectional shape uniform in the perpendicular plane. Accordingly, an end of each of the contact prevention members 50D of the present embodiment opposite to the head portion 52D thereof has a size smaller than a shape which is defined by the inner wall 38D of the main portion 36D in the perpendicular plane. Specifically, each of the contact prevention members 50D of the present embodiment is formed with a large shape portion (head portion 52D) only at one end in the predetermine direction, wherein the large shape portion (head portion 52D) projects outwards beyond a shape which is defined by the inner wall 38D of the main portion 36D in the perpendicular plane.

Figure 27:
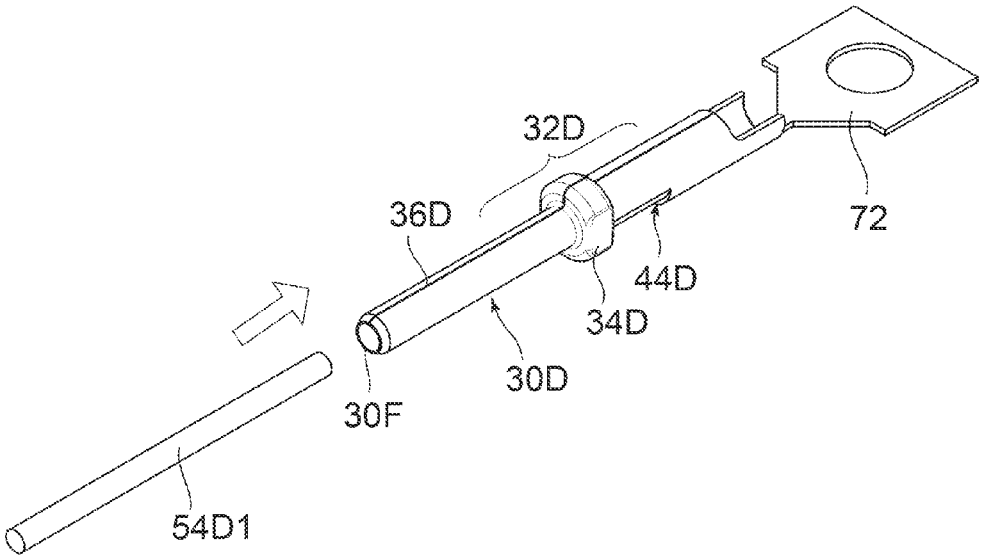
FIG. 27 is a perspective view showing a state before assembling the contact and the contact prevention member of FIG. 24. The contact prevention member is not yet formed with a large shape portion.
Figure 28:
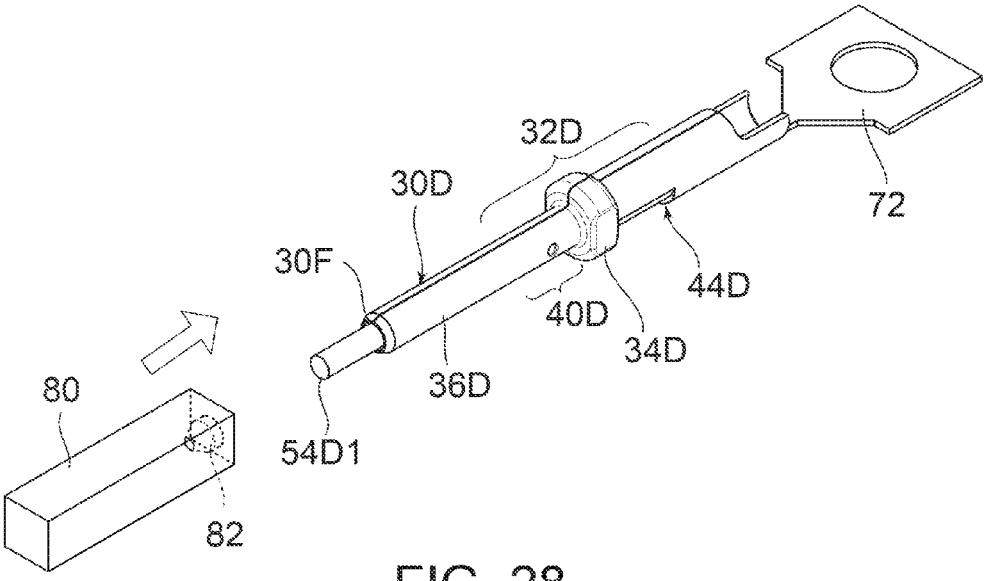
FIG. 28 is a perspective view showing a state following the state of FIG. 27. The contact is formed with the crimped portion.
Figure 29:
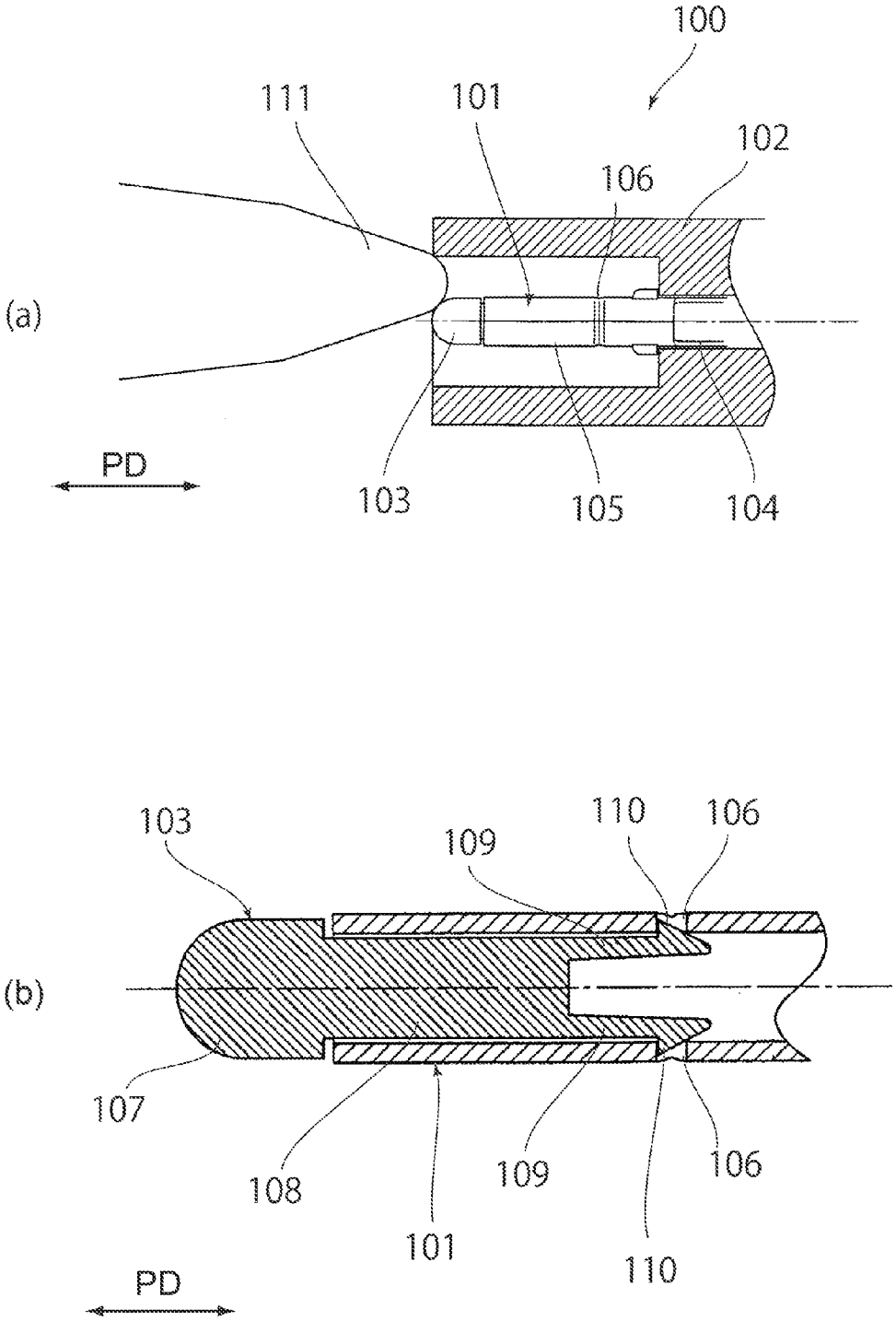
FIG. 29 PRIOR ART
FIG. 29 is a cross-sectional view showing a connector of JP 3,575,295B.

As shown in FIGS. 27 and 28, each of the contact prevention members 50D of the present embodiment is formed by thermally welding a rod material 54D1 made of resin by use of a jig 80. The illustrated contact 30D is connected to the carrier 72. The carrier 72 holds the contact 30D upon formation of the contact prevention member 50D.

In detail, with reference to FIG. 27, after a continuously-formed, long rod material 54D1 is inserted into the main portion 36D of the contact 30D, the rod material 54D1 is cut so as to have a predetermined length. Alternatively, the rod material 54D1 may be first cut to have the predetermined length, and then may be inserted into the main portion 36D of the contact 30D. Thereafter, a part of the contact 30D is crimped to form a crimped portion 40D, so that the rod material 54D1 is fixed so as not to be moved in the predetermined direction. In this state, as shown in FIG. 28, an end of the rod material 54D1 projects frontward from the front end 30F of the contact 30D, and the head portion 52D is then formed by using the jig 80. The jig 80 is formed with a recess 82 which has a shape corresponding to a shape of the head portion 52D. After the jig 80 is heated over a melting point of the rod material 54D1, the heated jig 80 is pressed against the end of the rod material 54D1. Accordingly, the head portion 52D is formed while an excess resin is pushed into the main portion 36D so that the inner fit portion 56D is formed. In other words, the contact prevention member 50D is formed by the above-described process. After that, the carrier 72 is separated from the contact 30D.

In the above-described heating process with using the jig 80, the head portion 52D is closely fit on the front end 30F of the contact 30D in the predetermined direction while the inner fit portion 56D is closely fit on the inner wall 38D of the main portion 36D. Accordingly, looseness of the contact prevention member 50D (especially, the head portions 52D and the vicinities thereof) against the contact 30D can be suppressed.

In the above-described manufacturing method, the rod material 54D1 is inserted into the contact 30D and then a part of the contact 30D is crimped so that a position of the rod material 54D1 with respect to the contact 30D is fixed. However, the present invention is not limited thereto. For example, the contact 30D may be provided with a projection on its inside, and then the rod material 54D1 may be press-fitted into the contact 30D so that a position of the rod material 54D1 with respect to the contact 30D is fixed.

Instead of the rod material 54D1 having a simple shape, for example, a premolded insulator, such as the contact prevention member 50A as shown in FIG. 11, can be used. In that case, after the insulator is inserted into the contact 30A as shown in FIG. 12, the crimped portion 40A (see FIG. 9) is formed, and the jig 80 is then pressed against the insulator as shown in FIG. 28, so that the head portion 52D (large shape portion) is formed. In the above-described process, instead of forming the crimped portion 40A and pressing the jig 80 against the insulator, the jig 80 may be pressed against the insulator as shown in FIG. 28 in a state where movement of the insulator is restricted by pressing a rear part of the large shape portion 56A (see FIG. 11). In this case, similar to the third embodiment, the large shape portions are formed at opposite ends of the contact prevention member, respectively. Nonetheless, the contact prevention member 50D has the large shape portion only at one end thereof. The contact prevention member 50D can be formed by using a resin rod having a simple shape and can be formed by the above-described manufacturing method suitable for automatization. Accordingly, the contact 30D including the contact prevention member 50D having the large shape portion only at one end thereof is advantageous in cost.

The above-described connectors 10, 10A, 10B and 10D are especially useful for a medical equipment which requires that a finger of a user is prevented from being brought into contact with tips of the contacts 30, 30A, 30B and 30D whose diameters are small.

The present application is based on Japanese patent applications of JP2013-245042 and JP2014-133000 filed before the Japan Patent Office on Nov. 27, 2013 and Jun. 27, 2014, respectively, the contents of which are incorporated herein by references.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a predetermined direction, the connector comprising:

a holding member;

a plurality of contacts; and a plurality of contact prevention members;

wherein:

the holding member includes a holding portion;

the contacts include held portions and main portions, respectively;

the whole of each of the held portions is held by the holding portion;

the main portions extend from the held portions, respectively, in the predetermined direction;

the main portions project over the holding portion in the predetermined direction;

each of the main portions has a tubular shape;

each of the contact prevention members is made of an insulator;

the contact prevention members extend in the insides of the main portions so as to occupy all of a length of each of the main portions, respectively, in the predetermined direction;

the contact prevention members project over the main portions, respectively, in the predetermined direction;

each of the main portions has an inner wall which defines a predetermined shape in a perpendicular plane perpendicular to the predetermined direction;

each of the contact prevention members has a lame shape portion which projects over the main portion in the predetermined direction;

the large shape portion is a thermal welded portion which projects outwards beyond the predetermined shape in the perpendicular plane;

each of the contact prevention members further has an inner fit portion and a shaft portion;

the lame shape portion is in contact with the main portion without any gaps therebetween in the predetermined direction;

the inner fit portion is positioned between the lame shape portion and the shaft portion in the predetermined direction;

the inner fit portion is closely fit on the whole inner wall of the main portion in the perpendicular plane; and the shaft portion has a size smaller than the inner fit portion in the perpendicular plane.

2. The connector as recited in claim 1, wherein each of the main portions is formed with no hole which connects between an inside and an outside of the main portion in a direction perpendicular to the predetermined direction.

3. The connector as recited in claim 1, wherein each of the main portions has a cross-sectional shape uniform in a plane perpendicular to the predetermined direction.

4. The connector as recited in claim 1, wherein each of the contacts is formed with a crimped portion which holds the contact prevention member.

5. The connector as recited in claim 4, wherein the crimped portion is formed on the held portion.

6. The connector as recited in claim 4, wherein:

each of the contact prevention members has two ends in the predetermined direction; and only one of the two ends of each of the contact prevention members is formed with the large shape portion which projects outwards beyond the predetermined shape in the perpendicular plane.

7. The connector as recited in claim 1, wherein each of the contacts is a pressed member which is wound on the contact prevention member.

8. The connector as recited in claim 7, wherein:

each of the contact prevention members has two ends in the predetermined direction; and each of the two ends of each of the contact prevention members is formed with the large shape portion which projects outwards beyond the predetermined shape in the perpendicular plane.

9. The connector as recited in claim 1, wherein each of the contact prevention members has another end which is not formed with the large shape portion and which is smaller than the predetermined shape in the perpendicular plane.

10. The connector as recited in claim 1, further comprising a shell made of metal, wherein the shell surrounds the main portions of the plurality of contacts altogether in a plane perpendicular to the predetermined direction.

11. The connector as recited in claim 1, wherein:

the holding member has a surrounding portion which extends from the holding portion; and the surrounding portion surrounds the main portions of the plurality of contacts altogether in a plane perpendicular to the predetermined direction.

* * * * *